US005556040A

United States Patent [19]

Irie et al.

[11] Patent Number: 5,556,040

[45] Date of Patent: Sep. 17, 1996

[54] METHOD AND APPARATUS FOR IMPROVING DISPERSIBILITY OF VEGETABLE FIBER

[75] Inventors: Shoichiro Irie; Motonobu Abe; Norihito Akiyama, all of Yokohama, Japan

[73] Assignees: ASK Corporation; Sanshin Thermal Insulation Co., Ltd., both of Yokohama, Japan

[21] Appl. No.: 183,290

[22] Filed: Jan. 19, 1994

[30] Foreign Application Priority Data

May 21, 1993 [JP] Japan ..... 5-120113

[51] Int. Cl.[6] ..... B02C 4/08; B02C 4/28

[52] U.S. Cl. ..... 241/24.29; 241/29; 241/157

[58] Field of Search ..... 241/24, 30, 157, 241/260.1, 29, 24.29

[56] References Cited

U.S. PATENT DOCUMENTS

| | | | |
|---|---|---|---|
| 395,413 | 1/1889 | Winchell | 241/157 |
| 1,181,967 | 5/1916 | Curtis et al. | 241/157 |
| 3,265,558 | 8/1966 | Bidwell | 241/157 |
| 4,757,948 | 7/1988 | Nonaka et al. | 241/7 |
| 5,156,872 | 10/1992 | Lee | 426/489 |
| 5,383,609 | 1/1995 | Prater et al. | 241/29 |

FOREIGN PATENT DOCUMENTS

| | | |
|---|---|---|
| 412281 | 6/1934 | United Kingdom . |
| 416530 | 9/1934 | United Kingdom . |

*Primary Examiner*—John Husar

*Attorney, Agent, or Firm*—Oblon, Spivak, McClelland, Maier & Neustadt, P.C.

[57] ABSTRACT

A method of improving dispersibility of vegetable fiber in which vegetable fibers obtained by opening up a vegetable material are caused to pass through at least one set of rolls to improve the dispersibility of the vegetable fibers, where each set of rolls comprises at least two rolls which have a large number of teeth or a large number of pins and are rotated in the same direction. According to the present invention, it is possible to improve dispersibility of vegetable fibers which have conventionally been unable to be uniformly blended with other materials due to lumping and/or entwining, thereby providing an advantage that uniform blending with other materials becomes possible.

14 Claims, 3 Drawing Sheets

METHOD AND APPARATUS FOR IMPROVING DISPERSIBILITY OF VEGETABLE FIBER

FIELD OF THE INVENTION

The present invention relates to methods of improving dispersibility of vegetable fiber and to an apparatus for use in such methods.

DISCUSSION OF THE BACKGROUND

Vegetable fibers are used in a wide variety of fields and various proposals have been made with respect to methods of their production. Methods of producing fiber using, for example, bamboo as the vegetable material have already been proposed by the present inventors. For example, a method of producing bamboo fiber is disclosed in Japanese Patent Laid-Open No. 4-216007 (UK 2 251 002 in part), including: a first step of crushing a bamboo material along the growing direction of the bamboo by means of a rolling mill; and a second step of opening up the bamboo material obtained from the first step by sending it by means of a feed roll to an opening device which has a rotary drum with a large number of teeth. Further, in the specification of Japanese Patent Laid-Open Application No. 5-138617 (UK 2 251 002 in part), a method of producing bamboo fiber has been proposed, including: a first step of crushing a bamboo material along the growing direction of the bamboo by means of a rolling mill; a second step of opening the bamboo material obtained at the first step by a rag opener; and a third step of forming the bamboo material obtained at the second step into fine fibers by means of a turbo-mill. These are methods for producing bamboo fibers in a quick and efficient manner.

It has been found, however, that, when the bamboo fibers obtained by the above methods are blended with a cement and formed into a bamboo fiber-cement formed body, there is about a 15% difference in the flexural strength of the obtained formed body between the case of using the bamboo fibers with a thin peel portion at the inside of the bamboo material and the case of using the bamboo fibers with the thin peel portion removed. The bamboo fiber without the thin peel portion is superior in this regard. For this reason, in the specification of Japanese Patent Application No. 4-177070 (UK 92 25711.6), the present inventors have furthermore proposed a method of producing bamboo fiber, including: a first step of crushing a bamboo material along its growing direction by means of a rolling mill; a second step of forming the crushed product obtained at the first step into fibers by means of a hammer mill type crusher having a certain mechanism; and a third step of removing the thin peel portion inside the bamboo material that is mixed into the bamboo fibers obtained at the above second step.

However, when using the bamboo fibers obtained by these methods to produce a bamboo fiber-cement formed body or the like, blending of the bamboo fibers with other materials is necessary as described above. However, if the dispersibility of the bamboo fibers is inferior, there are the disadvantages that a uniform blending with the other materials is difficult to obtain or production efficiency is low because it takes time to obtain a uniform mixture. Particularly, if the fiber diameter of the bamboo fibers is thin, the fibers tend to entwine around each other to hamper homogeneous mixing with the other materials. Thus the superior reinforcing effect possessed by vegetable fibers has not been fully utilized.

Accordingly, a method using a surface-active agent, for example, has been proposed as a method for improving the dispersibility of vegetable fiber when the vegetable fibers are in the form of a slurry in a large amount of water. However, the methods to be used in cases where a surface-active agent is not desirable and methods for improving the dispersibility of vegetable fiber when blending is effected in a half-wet state have not been developed heretofore.

Accordingly, it is an object of the present invention to provide a method and apparatus for improving the dispersibility of vegetable fibers in order to produce vegetable fibers having a high dispersibility that can be easily blended with other materials.

SUMMARY OF THE INVENTION

The invention provides a method of improving dispersibility of vegetable fiber, comprising the step of passing a body of vegetable fibers, obtained by opening up a vegetable material, through one or more sets of rolls in the absence of a continuous water phase to improve the dispersibility of the vegetable fibers, each of said sets comprising at least two spaced rolls having a multiplicity of teeth or pins and being operated with relative movement at the periphery to apply shear forces to the body of fibres.

Preferably the rolls in each set are rotated, the rotation being in the same direction so that the shear forces are applied between oppositely moving surfaces.

The invention further provides an apparatus for improving dispersibility of vegetable fiber, comprising one or more sets of rolls each of said sets comprising at least two rolls having a multiplicity of teeth or pins and disposed with a desired separation to apply shear forces to a body of fibres passed therebetween, and wherein in each set the rolls are operable with relative movement at the periphery, desirably so that the peripheral speed of one of said rolls, rotatable in the same direction as the direction of travelling of vegetable fibers may be larger than the peripheral speed of another of said rolls, rotatable in a direction opposite to the direction of travel of the vegetable fibers.

Further aspects of the invention, both as to the method and in regard to apparatus are set out in the claims herein, to which reference should be made. The following however is a description of embodiments of the invention, by way of example.

DETAILED DESCRIPTION OF THE INVENTION

A method and apparatus according to the present invention will now be described in detail by way of the accompanying drawings.

Figure 1:
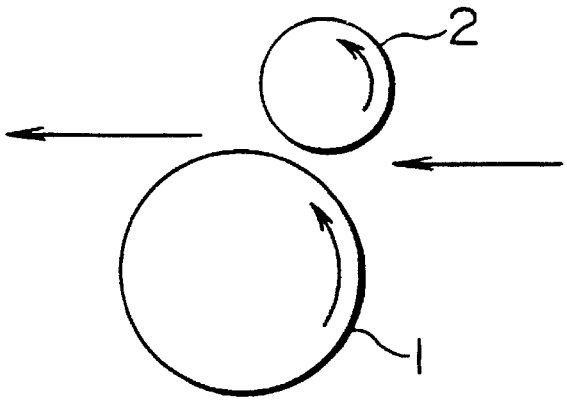
FIG. 1 is a view showing a mode of embodying a set of rolls of an apparatus of the present invention.
Figure 2:
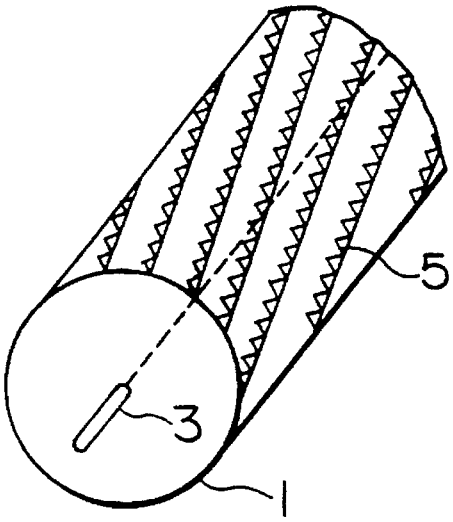
FIG. 2 is a view showing a mode of embodying a roll to be used in the apparatus of the present invention.
Figure 3A:
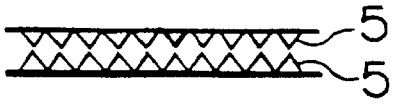
FIG. 3 is an explanatory view of modes for meshing a set of rolls.
Figure 3B:
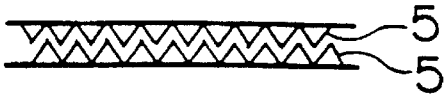
Figure 4:
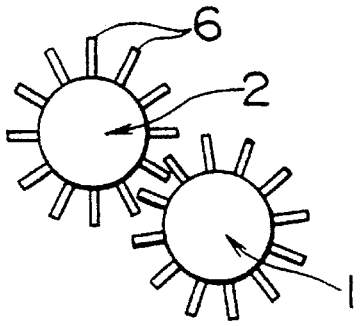
FIG. 4 is an explanatory view of a mode for embodying a set of rolls having pins.
Figure 5:
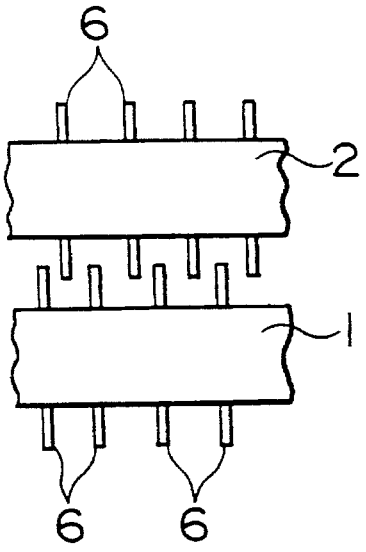
FIG. 5 is an explanatory view of a mode for meshing a set of rolls having pins.

FIG. 1 shows the construction of rolls in a mode for embodying an apparatus of the present invention. Referring to FIG. 1, a set of rolls is constituted by a roll 1 and a roll 2. A large number of teeth or a large number of pins are provided on the roll 1 and the roll 2. Although the shape of the teeth 5 is not limited, it is preferred, as shown in FIG. 2, that they have a triangular shape and that they be disposed at a small incline with respect to a rotating shaft 3 of the roll. The roll 1 and the roll 2 constituting the set of rolls are disposed at a predetermined interval from each other and the meshing of the teeth 5 of the set of rolls is not particularly limited and may be either as shown in FIG. 3(*a*) or as shown in FIG. 3(*b*). Further, shown in FIG. 4 and FIG. 5 is the case of a construction where the roll 1 and the roll 2 have a large number of pins 6.

The set of rolls having the construction as described are rotated in the same direction. Here, when the traveling direction of vegetable fibers to be processed and the rotating direction of the rolls 1 and 2 are respectively in the directions indicated by the arrows in FIG. 1, the number of rotations of rolls 1 and 2 are controlled such that the peripheral speed of roll 1 is greater than the peripheral speed of roll 2. The teeth or the pins are rotated in the opposite direction to one another at points where the teeth 5 or the pins 6 disposed on the rolls mesh with each other. The vegetable fibers are unraveled at such points and lumps and twining thereof are eliminated. It is thereby possible to improve their dispersibility with another material or the like.

Figure 6:
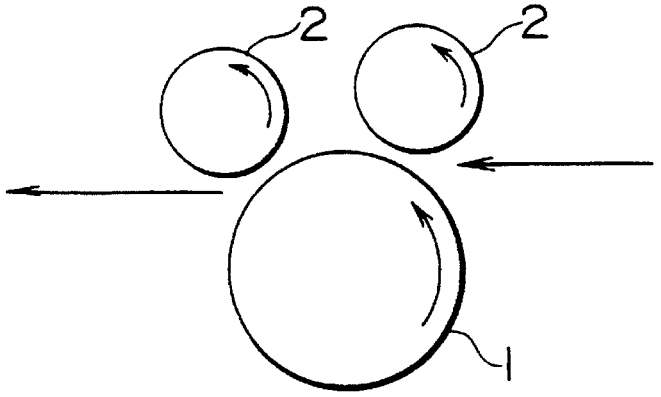
FIG. 6 is a view showing another mode for embodying a set of rolls of the apparatus of the present invention.

It should be noted that, the set of rolls may be formed as shown in FIG. 6 from a roll 1 and two rolls 2, and the numbers of rolls 1 and 2 constituting a set of rolls are not limited. Further, the diameters of rolls 1 and 2 are not limited and it suffices to control the peripheral speeds of rolls 1 and 2 in the manner as described above. Furthermore, the pitch and height of the teeth 5 or the pins 6 are not limited and may be variously changed according to state of entwining, type, length, moisture content, and so forth of the vegetable fiber to be processed. On the other hand, the separation between the rolls 1 and 2, i.e., the separation between the teeth 5 or between the pins 6 on two rolls is preferably 50 mm or less, more preferably 2 to 35 mm, though it is not limited and may be variously changed according to the dimensions and shape of the vegetable fiber to be processed. A separation exceeding 50 mm is not preferable because the effect for improving dispersibility becomes difficult to obtain.

In the method of the present invention, the vegetable fibers are passed between a set of rolls having the construction as described above. It is thereby possible to eliminate lumps and twining of the vegetable fibers to improve their dispersibility. Thus, uniform blending with other materials becomes possible. Here, if the effect of improving dispersibility is relatively limited when the vegetable fibers are passed through only one set of rolls, the vegetable fibers may also be processed so that they are caused to pass through sets rolls a plurality of times by providing a plurality of sets of rolls in the apparatus or by providing means for causing them to pass through a set of rolls a plurality of times.

Although description is given in the present specification in regards to the bamboo fiber as an example of vegetable fibers, the present invention is not limited thereto. It may also be implemented by using various vegetable fibers and the source and the manufacturing process of the vegetable fiber are not limited. However, when the method of the present invention is to be implemented, the moisture content of the vegetable fiber is preferably 10% or more. An undesirable powdering of the vegetable fiber may occur, if the vegetable fiber is dried to have a moisture content of less than 10%. It should be noted that the moisture content is not limited where an occurrence of powder does not particularly cause a problem. Further, substantially uniform blending may be effected by blending with a known method, if the average fiber diameter of the vegetable fibers exceeds 1 mm, though it also depends on such conditions as the length of the vegetable fibers. The present invention is thus effective particularly for those vegetable fibers with an average fiber diameter of 1 mm or less.

It should be noted that, while the method etc. of opening up vegetable material to obtain vegetable fibers, are not limited, a wet opening method, for example, may be used. Production method of wood pulp is an instance of the wet opening method. For example, when kraft pulp is to be produced, the material wood chip is digested by means of a mixed solution of caustic soda and sodium sulfide. In some cases, this is further subjected to wet beating by means of a beater or a disc refiner.

Next, in the case where the vegetable fiber is to be treated in a wet process, it is possible to use such methods as one implemented for bamboo fiber, already proposed by the present applicant (Japanese Patent Laid-Open No. 2-26854) in which a bamboo material is caused to absorb water to bring its moisture content to 100% or more and the moisture content thereof is then lowered by more than 50% by means of dehydration.

In the case where opening of the vegetable fibers as described is of a wet opening method or where the vegetable fibers are to be blended with other materials after being subjected to a wet processing, the fibers entwine around each other where it is difficult to perform a uniform blending. The method of the present invention is particularly effective when the vegetable fibers to be treated are in their wet state due to the processing as described. Generally, the dispersibility of vegetable fibers is extremely reduced for example when the vegetable fibers produced by a wet method or the vegetable fibers treated with water and then dehydrated are to be mixed with other materials. However, by treating the vegetable fibers in such wet state with the method of the present invention, their dispersibility is greatly improved so that a uniform blending is possible.

According to the present invention, it is possible to improve the dispersibility of vegetable fibers which, in the prior art, have been unable to be homogeneously blended with other materials due to lumps and entwining thereof and there is an advantage that a homogeneous blending with other materials becomes possible.

EXAMPLES (1) Production Example 1 of Bamboo Fiber:

A rolling mill having rolls made of carbon steel (S45C) with roll diameters of 150 mmϕ and roll lengths (effective length) of 500 mm was used to effect rolling at a pressure of 25 kg/cm$^2$, a feed roll speed of 15 m/min and a throughput of 180 kg/hour. The bamboo material used was shorn of its leaves after being felled and was cut into pieces each having a length of about 1 m.

Next, the rolled bamboo material was opened up into fibers by feeding it by means of a feed roll to a drum which was rotated at about 1000 rpm, having a drum diameter of 500 mm, an effective drum length of 900 mm and a large number of triangular teeth provided thereon. Since powdered bamboo material was also contained in the bamboo fibers obtained by means of such opening process, the fibers and the powder were separated from each other by means of dry sieving.

After the above process, bamboo fibers of an average fiber length of 25 mm and an average diameter of 0.5 mm were obtained. The moisture content of fiber at this point was 28%.

(2) Production Example 2 of Bamboo Fiber:

A rolling mill identical to that in (1) was used at a pressure of 25 kg/cm$^2$ and a feed roll speed of 15 m/min to roll a bamboo material.

Next, a hammer mill type crusher (MHM horizontal crusher, manufactured by Miike Tekkosho) was used; a 25 mm-mesh screen was provided at the bottom of the crusher; and the crusher was operated at 30 HP for one hour to obtain 120 kg of bamboo fibers having an average fiber length of 25 mm and an average diameter of 0.2 mm from the rolled bamboo material. In this condition, the thin peel portion at the inside of the bamboo material was separated from and mixed in the bamboo fibers.

Next, the obtained bamboo fibers were soaked and the thin peel portions formed into small pieces, floated to the water surface and were removed. After the bamboo fibers deprived of the thin peel portions were removed from the water, the moisture content thereof was measured to be 800%. The obtained bamboo fibers were then pressure-dehydrated to obtain bamboo fibers with a moisture content of 150%.

Figure 7:
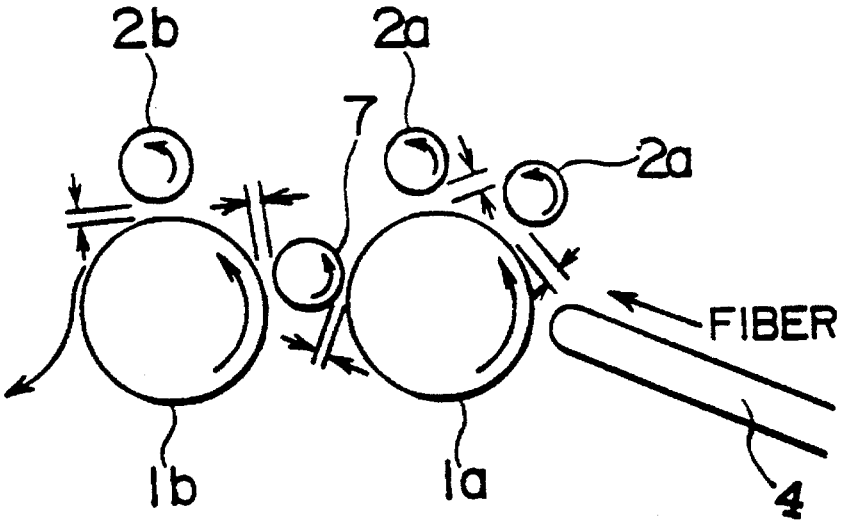
FIG. 7 is a schematic view showing an apparatus used in an embodiment of the present invention.

(3) Processing for Improving Dispersibility:

The bamboo fibers obtained in the manner of (1) and (2) above were subjected to processing for improving the dispersibility of bamboo fibers by using an apparatus as shown in FIG. 7. Dimensions, shape and rotating speed of roll 1*a*, roll 1*b*, rolls 2*a*, roll 2*b* and feed roll 7 of the apparatus were as follows.

Figure 8:
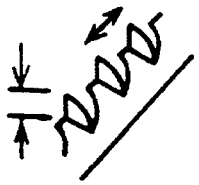
FIG. 8 is an explanatory view of the shape of teeth of a roll used in the embodiment.
Figure 9:
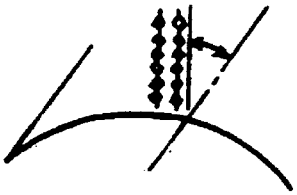
FIG. 9 is an explanatory view of the angle of the teeth of the roll of the apparatus used in the embodiment.

| | |
|---|---|
| Rolls 1a: | diameter: 600 nm |
| 1b | height of teeth: 10 mm (see FIG. 8) |
| | pitch of teeth: 12 mm (see FIG. 8) |
| | attaching angle of teeth with respect to rotating shaft of roll: 4° (see FIG. 9) |
| | rotating speed 1a: 240 rpm |
| | rotating speed 1b: 250 rpm |
| Rolls 2a: | diameter: 200 mm |
| 2b | height of teeth: 10 mm |
| | pitch of teeth: 12 mm |
| | attaching angle of teeth with respect to rotating shaft of roll: 1.5° |
| | rotating speed 2a: 150 rpm |
| | rotating speed 2b: 160 rpm |
| Feed roll 7: | diameter: 200 mm |
| | height of teeth: 10 mm |
| | pitch of teeth: 12 mm |
| | attaching angle of teeth with respect to rotating shaft of the roll: 1.5° |
| | rotating speed: 750 rpm |

It should be noted that spacing between the roll 1*a* and the rolls 2*a* was such that there was a separation of 30 mm from the roll 2*a* located on the fiber introduction side of the two rolls 2*a* and the separation between the next roll 2*a* and the roll 1*a* was 20 mm. The separation between the roll 1*b* and the roll 2*b* was 10 mm; the separation between the roll 1*a* and the feed roll 7 was 5 mm; and the separation between the feed roll 7 and the roll 1*b* was 10 mm. The bamboo fibers obtained in Production Examples (1) and (2) above were sent by means of a conveyor 4 to the apparatus having the above dimensions, shape and rotating speed, so that they were processed through the roll 1*a* and the rolls 2*a* as well as through the roll 1*b* and the roll 2*b* which were rotated in the same direction.

(4) Production Examples of Formed Body:

Formed Body Production Example 1 Using a Comparative Product

The bamboo fibers (non-processed) obtained by Production Example (1) above were introduced into an AIKO mixer (AM-20 type manufactured by Aikosha Seisakusho). While operating the mixer, water and JIS No. 3 sodium silicate were added at 1.5% by solid content to a cement to bring the moisture content thereof to 150%. The cement was added thereto at a ratio of 70 to 30 of the bamboo fibers by dry weight and mixing was effected for 2 minutes. It was then pressed and was cured for two weeks to obtain a formed body. The specific gravity of the obtained formed body was 1.1 and its flexural strength was 120 kg/cm$^2$ when it was dry. When a section of the formed body was inspected, portions were found, where the bamboo fibers had entwined around each other and were not uniformly mixed with the cement.

Formed Body Production Example 2 Using a Comparative Product

A formed body was produced under the same conditions as in production Example 1 above but the mixing time was set to 5 minutes. The specific gravity of the obtained formed body was 1.1 while its flexural strength was 123 kg/cm$^2$ when it was dry, and portions where the bamboo fibers had entwined around each other and had not sufficiently mixed with the cement were found in a section of the formed body. It was impossible, however, to achieve uniform mixing even when the mixing time was made longer than this.

Formed Body Production Example 3 Using a Product Processed According to the Present Invention The bamboo fibers obtained by the Production Example (1) above and subjected to the processing as described in (3) were used to make a formed body under the same conditions as in production Example 1 above. The specific gravity of the obtained formed body was 1.1 and its flexural strength was 145 kg/cm$^2$ when it was dry. Further, sections on the formed body were substantially uniform and it was verified that mixing of the bamboo fibers and the cement was homogeneous.

Formed Body Production Example 4 Using a Comparative Product

The bamboo fibers obtained by the Production Example (2) above had become somewhat harder due to the pressure-dehydration processing. Thus, they were subjected to disentangling for ten minutes in the AIKO mixer. Next, a cement was added at the ratio of 75 to 25 of the bamboo fibers by dry weight and they were mixed for 2 minutes. The obtained product was then press-formed and cured for two weeks to obtain a formed body. The specific gravity of the obtained formed body was 1.1 and its flexural strength was 115 kg/cm$^2$ when it was dry. When a section of the formed body was inspected, a large number of portions were found where the bamboo fibers entwined around each other and were not uniformly mixed with the cement.

Formed Body Production Example 5 using a Comparative Product

The mixing time with the cement was increased to 5 minutes under conditions identical to the above production Example 4. There was no difference in the flexural strength and portions with insufficient mixing were also substantially the same as in production Example 4.

Formed Body Production Example 6 Using a Product Processed According to the Present Invention The bamboo fibers obtain by Production Example (2) above and subjected to the processing as described in (3) and a cement were introduced into an AIKO mixer at the ratio by dry weight of 25 to 75. They were mixed for 2 minutes and the thus obtained product was then press-formed and cured for two weeks to obtain a formed body. The specific gravity of the obtained formed body was 1.1 and its flexural strength was 168 kg/cm$^2$ when it was dry. Sections on the formed body were uniform and it was confirmed that the bamboo fibers and the cement had mixed uniformly.

What is claimed is:

1. A method of improving dispersibility of vegetable fiber, the method comprising the steps of: unraveling entwined fibers in a body of vegetable fibers by passing the body of vegetable fibers including the entwined fibers, which are obtained by opening up a vegetable material, through at least one set of rolls in the absence of a continuous water phase to improve dispersibility of the vegetable fibers, said at least one set of rolls comprising at least two spaced rolls having a multiplicity of protruding members; and rotating the at least two spaced rolls in said at least one set in the same direction with relative movement between each other at a periphery to apply shear forces to the body of fibers, such that the shear forces are applied between oppositely moving surfaces to unravel the entwined fibers.

2. A method according to claim 1, wherein a moisture content of the vegetable fibers at the time of being passed through the rolls is 10% or more.

3. A method according to claim 1, wherein an average diameter of the vegetable fibers obtained by opening up said vegetable material is 1 mm or less.

4. A method according to claim 1, wherein the opening up of the vegetable material is by a wet opening method.

5. A method according to claim 1, wherein prior to improving the dispersibility and after the opening up of the vegetable material, the vegetable fibers are subjected to a wet processing.

6. A method according to claim 1, wherein said protruding members are teeth.

7. A method according to claim 6, wherein said teeth are disposed at an incline with respect to a rotational axis of each of said rolls.

8. A method according to claim 1, wherein said protruding members are pins.

9. A method according to claim 8, wherein said pins are disposed at an incline with respect to a rotational axis of each of said rolls.

10. An apparatus for improving dispersibility of vegetable fibers including entwined fibers, the apparatus comprising: at least one set of rolls which includes at least two rolls having a multiplicity of protruding members, said at least two rolls being rotatable with relative movement between each other at a periphery and being disposed with a desired separation to apply shear forces to a body of fibers passed therebetween, and wherein in said at least one set of rolls, a peripheral speed of one of said at least two rolls, rotatable in the same direction as the direction of travelling of the vegetable fibers is larger than a peripheral speed of the other of said at least two rolls;

wherein said at least two rolls rotate in the same direction to unravel the entwined fibers.

11. An apparatus according to claim 10, wherein said protruding members are teeth.

12. An apparatus according to claim 11, wherein said teeth are disposed at an incline with respect to a rotational axis of each of said rolls.

13. An apparatus according to claim 10, wherein said protruding members are pins.

14. An apparatus according to claim 13, wherein said pins are disposed at an incline with respect to a rotational axis of each of said rolls.

* * * * *